US010038287B2

(12) United States Patent
Yamada et al.

(10) Patent No.: US 10,038,287 B2
(45) Date of Patent: Jul. 31, 2018

(54) DEVICE CONNECTOR

(71) Applicant: Sumitomo Wiring Systems, Ltd., Yokkaichi, Mie (JP)

(72) Inventors: Hiroki Yamada, Yokkaichi (JP); Tadahiro Fukushima, Wako (JP); Kaoru Fukui, Wako (JP); Tsukasa Aiba, Wako (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/545,742

(22) PCT Filed: Jan. 15, 2016

(86) PCT No.: PCT/JP2016/051137
§ 371 (c)(1),
(2) Date: Jul. 24, 2017

(87) PCT Pub. No.: WO2016/121533
PCT Pub. Date: Aug. 4, 2016

(65) Prior Publication Data

US 2018/0019556 A1 Jan. 18, 2018

(30) Foreign Application Priority Data

Jan. 28, 2015 (JP) ..... 2015-014047

(51) Int. Cl.
*H01R 24/66* (2011.01)
*H01R 13/52* (2006.01)
*H01R 105/00* (2006.01)

(52) U.S. Cl.
CPC ..... *H01R 24/66* (2013.01); *H01R 13/5202* (2013.01); *H01R 13/5219* (2013.01); *H01R 2105/00* (2013.01)

(58) Field of Classification Search
CPC . H01R 24/66; H01R 13/5202; H01R 13/5219
(Continued)

(56) References Cited

U.S. PATENT DOCUMENTS 6,305,975 B1 * 10/2001 Steiner ..... H01R 13/5202 174/18
7,329,145 B2 * 2/2008 Yagome ..... H01R 13/506 439/271

(Continued)

FOREIGN PATENT DOCUMENTS

| | | |
|---|---|---|
| JP | 2011-165383 | 8/2011 |
| JP | 2012-216336 | 11/2012 |
| JP | 2013-20872 | 1/2013 |

OTHER PUBLICATIONS

International Search Report dated Apr. 5, 2016.

*Primary Examiner* — Alexander Gilman
(74) *Attorney, Agent, or Firm* — Gerald E. Hespos; Michael J. Porco; Matthew T. Hespos

(57) ABSTRACT

A device connector 10 to be attached to a case C of a device includes: a housing 30 to be fitted in an attachment hole C1 of the case C; a seal groove 41 provided in an inner housing 31 constituting the housing 30, and having a back surface 42 disposed opposite an outer peripheral edge portion C2 of the attachment hole C1 of the case C; a face seal 43 fitted in the seal groove 41 to waterproof a gap between the outer peripheral edge portion C2 of the attachment hole C1 and the back surface of the seal groove 41; and a relief groove 57 disposed adjacently outside the seal groove 41 in an outer housing 50 constituting the housing 30 and along the seal groove 41, and recessed upward relative to a lower surface of the tubular portion 51 of the outer housing 50.

9 Claims, 6 Drawing Sheets

(58) Field of Classification Search
USPC ..... 439/273
See application file for complete search history.

(56) References Cited

U.S. PATENT DOCUMENTS 7,614,910 B2 * 11/2009 Croteau ..... H01R 13/512 439/559
8,366,470 B2 * 2/2013 Sakakura ..... H01R 4/34 439/272
8,545,265 B2 * 10/2013 Sakamoto ..... B29C 45/14 439/606
8,562,377 B2 * 10/2013 Kawamura ..... H01R 9/032 439/607.44
8,803,006 B2 * 8/2014 Imahori ..... H01R 9/032 174/539
9,287,653 B2 * 3/2016 Endo ..... H01R 13/60
9,318,849 B2 * 4/2016 Kobayashi ..... H01R 13/5205
9,325,120 B2 * 4/2016 Imahori ..... H01R 13/6592
9,825,398 B1 * 11/2017 Uchida ..... H01R 13/5219
2002/0157843 A1 * 10/2002 Fukushima ..... H01R 9/032 174/353
2010/0261364 A1 * 10/2010 Matsuoka ..... H01R 13/5202 439/271
2011/0195603 A1 * 8/2011 Fujiwara ..... H01R 13/6596 439/607.28
2011/0316373 A1 * 12/2011 Kobayashi ..... H01R 9/24 310/71
2012/0142214 A1 * 6/2012 Kawamura ..... H01R 4/34 439/571
2013/0017719 A1 * 1/2013 Tanaka ..... H01R 9/032 439/587
2013/0017720 A1 * 1/2013 Maegawa ..... H01R 13/521 439/595
2013/0084728 A1 * 4/2013 Omae ..... H01R 4/646 439/271
2013/0260585 A1 * 10/2013 Wang ..... H01R 13/5202 439/271
2014/0011401 A1 * 1/2014 Endo ..... H01R 13/5205 439/588
2014/0030921 A1 * 1/2014 Kobayashi ..... H01R 13/6591 439/607.01
2014/0038459 A1 * 2/2014 Kobayashi ..... H01R 9/032 439/607.41
2014/0287631 A1 * 9/2014 Tashiro ..... H01R 13/521 439/733.1
2014/0370753 A1 * 12/2014 Kobayashi ..... H01R 13/5205 439/607.41

* cited by examiner

DEVICE CONNECTOR

BACKGROUND

1. Field of the Invention

The technology disclosed in the present description relates to a device connector to be attached to a case of a device.

2. Description of the Related Art

An example of a conventional device-side connector attached to a shield case of a device is disclosed in Japanese Patent Application Laid-Open No. 2012-216336.

The device-side connector includes a device-side resin housing. The device-side resin housing has a brim-like flange portion at an outer periphery thereof. The flange portion has a seal groove to which a gasket is attached. When the device-side connector is attached to the shield case, the gasket is compressed by the shield case and the flange portion, whereby a gap between the shield case and the device connector is sealed.

Generally, when a seal member, such as a gasket, is compressed by a shield case and a flange portion, a slight gap is produced between the shield case and the flange portion. Accordingly, when the device-side connector is disposed in the engine room of a vehicle, for example, the gap may be penetrated by salt water. If salt water penetrates the gap, the salt water, being accumulated in the gap by surface tension, may be dried, crystallizing the salt in the gap. If the condition is repeated, the salt crystals become gradually larger, entering the gap between the gasket and the shield case and decreasing the sealing performance of the gasket.

SUMMARY

The present description discloses a technology for ensuring sealing performance of a seal member by suppressing crystallization of salt in a gap.

The technology disclosed in the present description includes a device connector to be attached to a case of a device. The device connector includes: a housing to be fitted in an attachment hole of the case; a seal groove provided in the housing and having a back surface disposed opposite an outer peripheral edge portion of the attachment hole of the case; a seal member fitted in the seal groove to waterproof a gap between the outer peripheral edge portion of the attachment hole and the back surface; and a relief groove disposed adjacently outside the seal groove of the housing and along the seal groove, and recessed on the back surface side relative to an outer surface of the housing.

In the device connector thus configured, because of the relief groove disposed in the outer periphery of the seal member, a large gap can be ensured by the relief groove between the case on the outside of the seal member and the device-side housing. Accordingly, accumulation of salt water between the case and the device-side housing due to surface tension can be prevented, whereby a decrease in sealing performance of the seal member due to salt water penetration can be prevented. In addition, the sealing performance of the seal member can be ensured.

Modes of the device connector disclosed in the present description may include the following configurations.

The relief groove may be opened in a side surface of the housing.

In this configuration, the water that has penetrated the relief groove can be easily discharged outside via the opening in the side surface of the housing.

An opening of the relief groove may be provided in a position where a distance from the seal groove to the side surface of the housing is shortest.

In this configuration, the discharge of water in the relief groove to the outside from the side surface of the housing can be facilitated.

The relief groove may include an extended-width groove formed outside the seal groove along an entire circumference of the seal groove, and a discharge channel communicating the extended-width groove with an external space that is beside the housing. The discharge channel may be disposed such that a part of the discharge channel on the extended-width groove side may be displaced from a part of the discharge channel on a side surface side of the housing with respect to a circumferential direction.

In this configuration, a part of the discharge channel on the extended-width groove side is displaced from a part of the discharge channel on the housing side surface side with respect to the circumferential direction. Accordingly, when, during cleaning, for example, high pressure waster is sprayed onto the side surface of the housing, forceful penetration of the extended-width groove by the water can be suppressed. In this way, the sealing performance of the seal member can be ensured.

According to the technology disclosed in the present description, crystallization of salt in a gap can be suppressed, whereby sealing performance of a seal member can be ensured.

DETAILED DESCRIPTION

First Embodiment

A first embodiment will be described with reference to FIG. 1 to FIG. 4.

The present embodiment illustrates a device connector 10 attached to a case C of a device, such as a motor mounted in the engine room of a vehicle. In the device connector 10, an electric wire-side connector (not illustrated) at the end of an electric wire is adapted to be fitted at a position on the opposite side from the case C.

Figure 1:
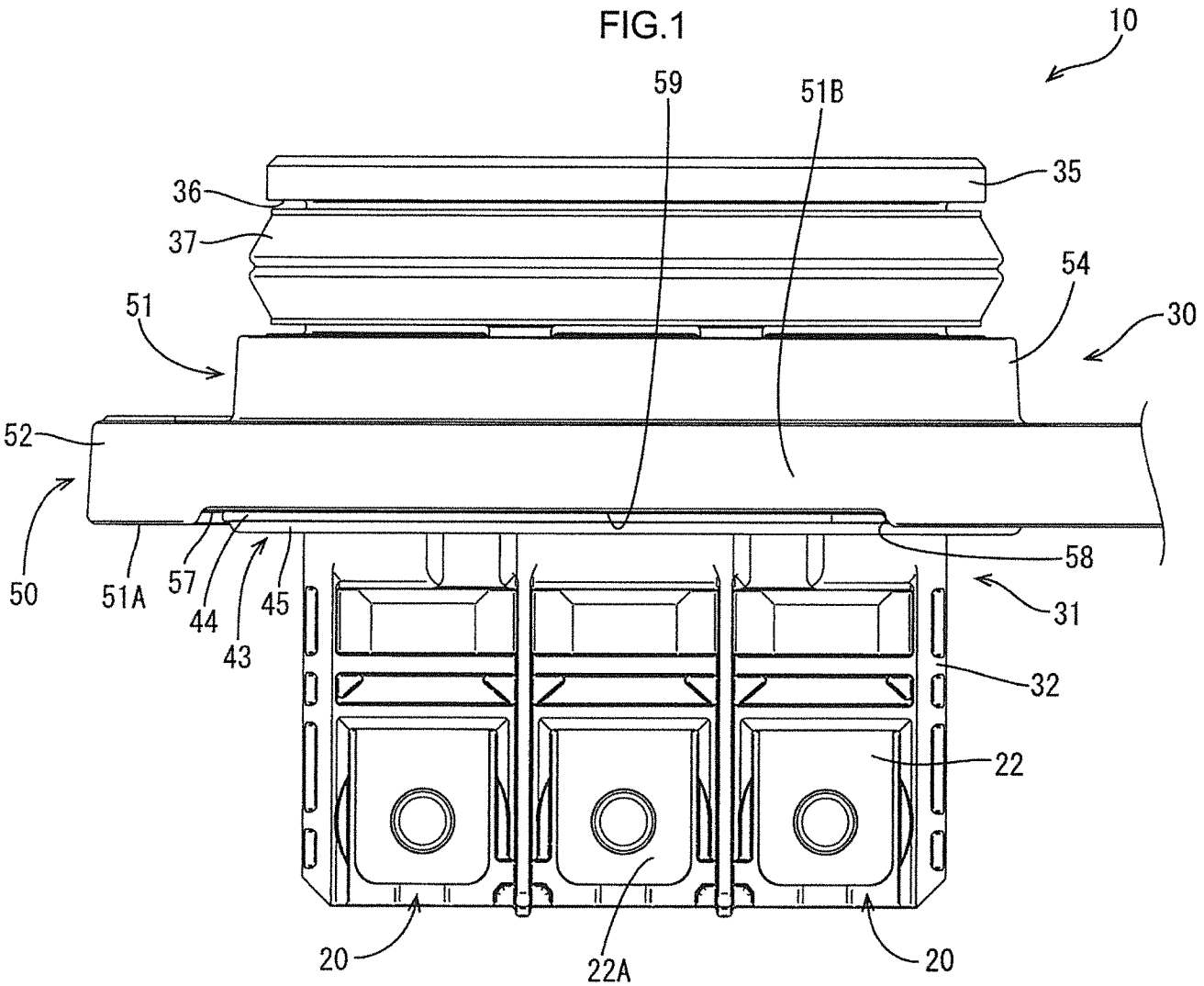
FIG. 1 is a front view of a device connector according to the first embodiment.
Figure 3:
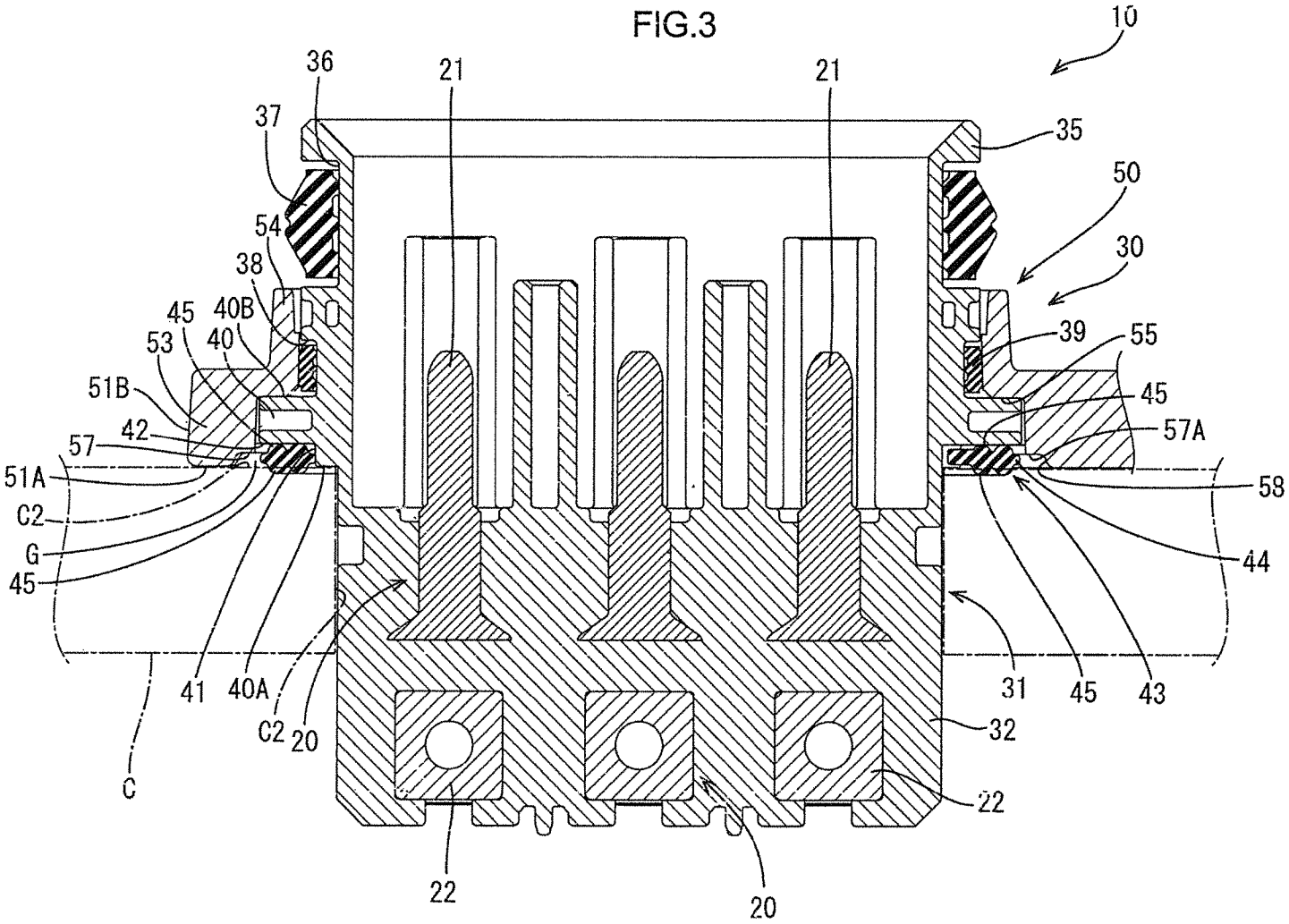
FIG. 3 is a cross sectional view taken along line A-A of FIG. 2.
Figure 4:
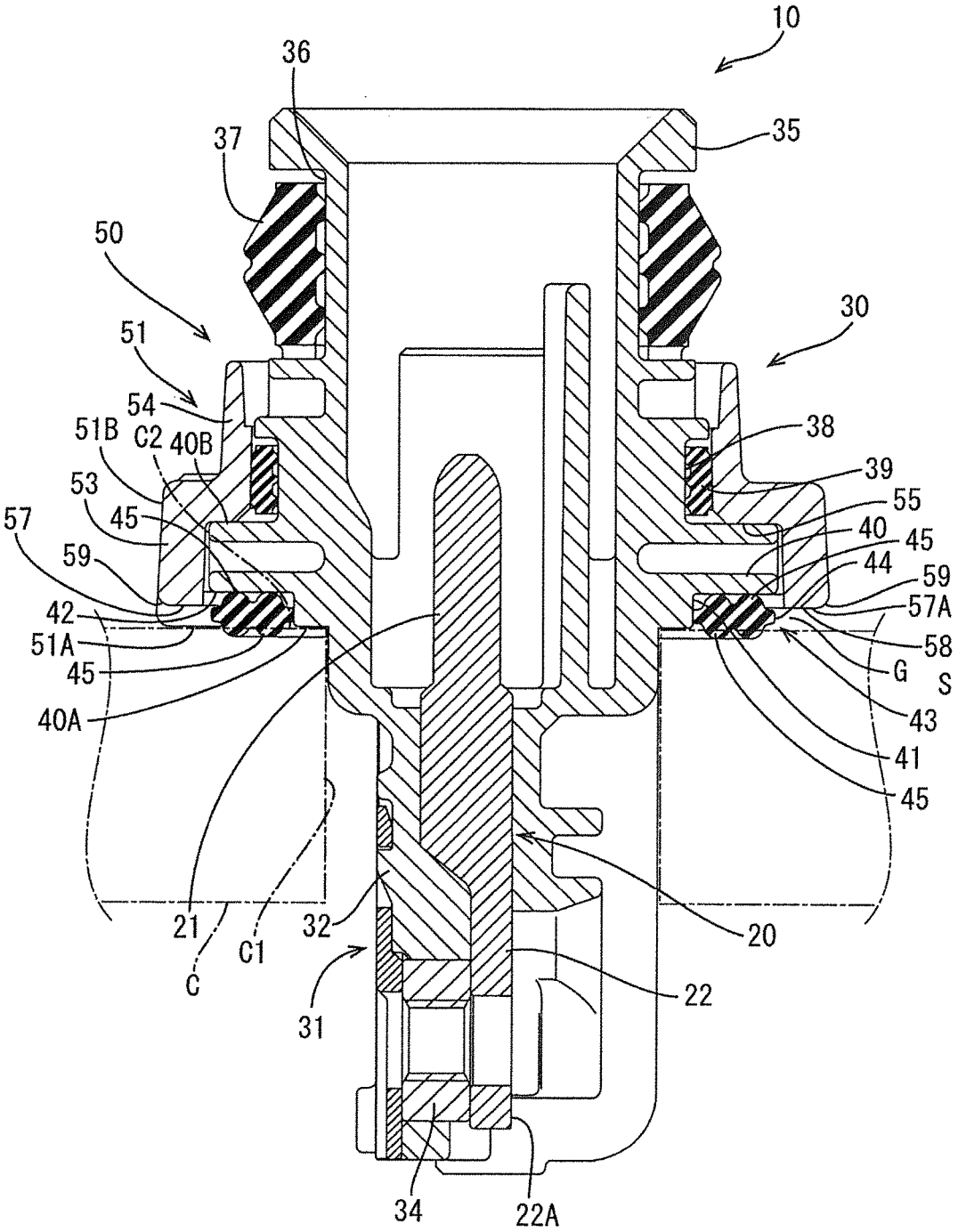
FIG. 4 is a cross sectional view taken along line B-B of FIG. 2.

As illustrated in FIG. 1, FIG. 3, and FIG. 4, the device connector 10 includes a plurality of terminals 20 extending in a top-bottom direction, and a housing 30 which holds the terminals 20 and is fixed to the case C.

The housing 30 includes an inner housing 31 formed from synthetic resin, with the plurality of terminals 20 buried by insert molding, and an outer housing 50 assembled to an outer peripheral surface of the inner housing 31.

As illustrated in FIG. 3 and FIG. 4, each of the terminals has an upper end portion including a pin-shaped terminal connecting portion 21, and a lower end portion including a planar device-side connecting portion 22.

The inner housing 31 includes a lower half including a terminal holding portion 32 holding the terminals 20. The terminal holding portion 32 is formed in a size enabling the same to be fitted in an attachment hole C1 provided in the case C. In a lower end portion of the terminal holding portion 32, the device-side connecting portions 22 of the terminals 20 are arranged in a width direction in an exposed state. In the terminal holding portion 32, on a rear-surface side on the opposite side from the surface 22A on which the device-side connecting portions 22 are exposed, nuts 34 are retained, as illustrated in FIG. 4. By inserting fastening bolts (not illustrated) through the device-side terminal, not illustrated, provided in the case C and the device-side connecting portions 22, and mounting the fastening bolts onto the nuts 34, the device-side terminal and the device-side connecting portions 22 are electrically connected.

As illustrated in FIG. 3 and FIG. 4, an upper half of the inner housing 31 includes a hood portion 35 to be fitted with the electric wire-side connector. The hood portion 35 is formed in an oval tubular shape with an upper opening. In the hood portion 35, terminal connecting portions 21 of the terminals 20 upwardly protruding from the terminal holding portion 32 are disposed side by side in the width direction. In an outer peripheral surface of an upper end portion of the hood portion 35, a first fitting groove 36 is circumferentially provided. In the first fitting groove 36, a rubber axial seal 37 for waterproofing a gap between the hood portion 35 and the electric wire-side connector is fittingly mounted.

In the outer peripheral surface at a substantially central portion in the top-bottom direction of the hood portion 35, a second fitting groove 38 is circumferentially provided. In the second fitting groove 38, a rubber ring-shaped fixing member 39 for temporarily fixing the outer housing 50 with respect to the inner housing 31 is fittingly mounted.

Below the second fitting groove 38, a flange 40 is circumferentially provided, extending outward from the outer peripheral surface of the hood portion 35 and along the entire circumference. In a lower surface 40A of the flange 40, a seal groove 41 with a rubber face seal (an example of "seal member") 43 fitted therein is formed along the outer peripheral surface of the hood portion 35. The seal groove 41 is open radially outward along the entire circumference, and recessed upward. The seal groove 41 has a back surface 42 disposed opposite an outer peripheral edge portion C2 of the attachment opening C1 of the case C in the top-bottom direction.

Figure 2:
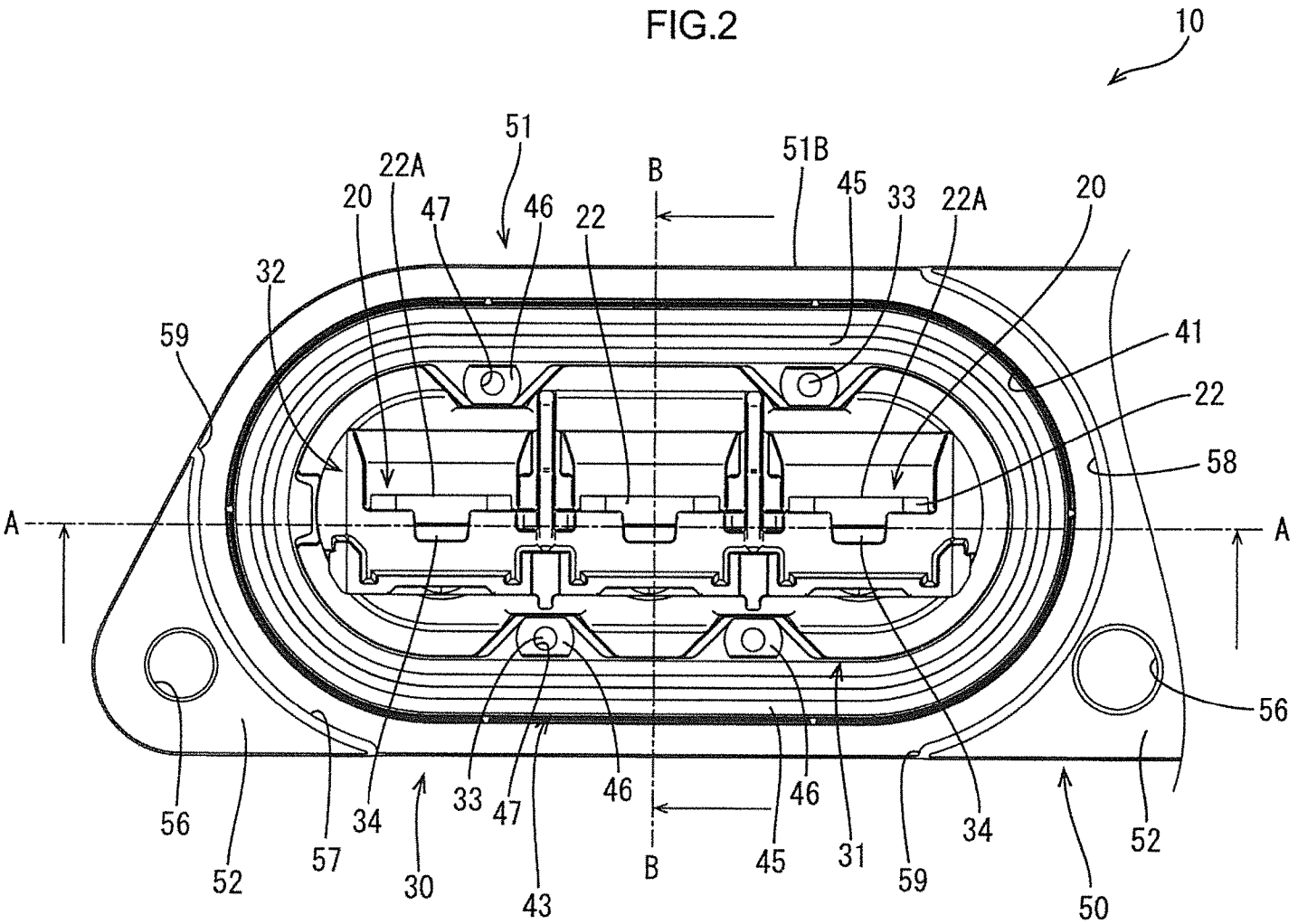
FIG. 2 is a bottom view of the same.

As illustrated in FIG. 2 to FIG. 4, the face seal 43 includes a seal body 44 including an oval sheet elongated in the width direction, with a plurality of ridges (in the present embodiment, two ridges on each surface) of lips 45 circumferentially provided and protruding outward from upper and lower surfaces of the seal body. The lips 45, when the terminal holding portion 32 of the inner housing 31 is fitted with respect to the attachment hole C1, are placed in intimate contact with the outer peripheral edge portion C2 of the attachment hole C1 of the case C and the back surface 42 of the seal groove 41, thereby waterproofing the gap between the case C and the inner housing 31. As illustrated in FIG. 2, on an inner peripheral surface of the seal body 44, a plurality of locking pieces 46 are provided. Locking protrusions 33 of the inner housing 31 are press-fit into locking holes 47 provided penetrating through the locking pieces 46, whereby the face seal 43 is fitted so as not to fall from the seal groove 41.

The outer housing 50 is made of die-cast aluminum, and includes, as illustrated in FIG. 2 to FIG. 4, a tubular portion 51 covering a lower half of the hood portion 35 of the inner housing 31, and planar fixing pieces 52 radially extending from the lower end portion of the tubular portion 51.

As illustrated in FIG. 1 and FIG. 3, the tubular portion 51 has an oval tubular shape elongated in the width direction. A lower part of the tubular portion 51 includes a large diameter portion 53 in which the flange 40 of the hood portion 35 is adapted to be fitted from below. An upper part of the tubular portion 51 includes a small diameter portion 54 in which a substantially central portion in the top-bottom direction of the hood portion 35 is intimately fitted from below. Between the small diameter portion 54 and the large diameter portion 53, as illustrated in FIG. 3 and FIG. 4, an abutting surface 55 is provided opposite an upper surface 40B of the flange 40 of the hood portion 35 in the top-bottom direction. The inner peripheral surface of the tubular portion 51 is stepped at the boundary of the abutting surface 55.

As illustrated in FIG. 3 or FIG. 4, when the hood portion 35 of the inner housing 31 is fitted into the tubular portion 51 from below, the upper surface 40B of the flange 40 abuts on the abutting surface 55 of the tubular portion 51 from below when the fitting is stopped. The ring-shaped fixing member 39 in the second fitting groove 38 of the hood portion 35 is compressed and becomes intimately attached by the inner peripheral surface of the small diameter portion 54 and the inner peripheral surface of the second fitting groove 38. In this way, the inner housing 31 and the outer housing 50 are temporarily fixed, forming the housing 30. When the housing 30 is formed, as illustrated in FIG. 2 to FIG. 4, the tubular portion 51 of the outer housing 50 is disposed at the outer periphery of the seal groove 41 of the inner housing 31, where the seal groove 41 is surrounded by the tubular portion 51.

As illustrated in FIG. 2, the fixing pieces 52 are provided in a row on both sides in the width direction of the tubular portion 51. In the fixing pieces 52, bolt insertion holes 56 are provided penetrating through in a plate-thickness direction. By fastening fixing bolts (not illustrated) into the case C through the bolt insertion holes 56, the fixing pieces 52 are fixedly bolted to the case C, thus attaching the device connector 10 to the case C. When the fixing pieces 52 are fixed to the case C, as illustrated in FIG. 3 and FIG. 4, the lips 45 of the face seal 43 fitted in the seal groove 41 of the flange 40 of the inner housing 31 are compressed by the lower surface 40A of the flange 40 and the outer peripheral edge portion C2 of the attachment hole C1 of the case C, whereby the gap between the inner housing 31 and the case C is waterproofed.

As illustrated in FIG. 2 to FIG. 4, in the lower surface 51A of the tubular portion 51 of the outer housing 50, a relief groove 57 is provided adjacent to the seal groove 41.

The relief groove 57 is recessed upward from the lower surface 51A of the tubular portion 51 of the outer housing 50 toward the back surface side of the seal groove 41. The relief groove 57 has a depth size which is substantially a half of the depth size of the seal groove 41. The relief groove 57 has a back surface 57A set at a position with substantially the same height as the upper surface of the seal body 44 of the face seal 43.

The relief groove 57 also includes, at the lower surface 51A of the tubular portion 51 disposed at the outer periphery of the seal groove 41, an extended-width groove 58 provided circumferentially along the seal groove 41. The extended-width groove 58 is provided along the entire circumference of the lower surface 51A of the tubular portion 51 disposed at the outer periphery of the seal groove 41, and thus has a laterally elongated oval shape with a substantially equal width. Accordingly, the extended-width groove 58 is laterally opened at portions where the fixing pieces 52 of the tubular portion 51 are not provided in a row. In other words, the extended-width groove 58 has openings 59 at two locations of the long side portions at side surfaces 51B of the tubular portion 51 where the distance from the seal groove 41 to the side surfaces 51B of the tubular portion 51 is the shortest.

The present embodiment is configured as described above. Next, the operation and effect of the device connector 10 will be described.

When the terminal holding portion 32 of the device connector 10 is fitted in the attachment hole C1 of the case C of the device, and as the fixing pieces 52 of the outer housing 50 are fixed to the case C with the fixing bolts, as illustrated in FIG. 3 and FIG. 4, the face seal 43 is compressed between the outer peripheral edge portion C2 of the attachment hole C1 of the case C and the flange 40 of the inner housing 31 of the housing 30. In this way, the gap between the inner housing 31 and the case C is waterproofed.

When the face seal 43 is compressed between the case C and the flange 40, a gap G is created between the case C and the flange 40. If salt water penetrates the gap G and is dried while being accumulated therein, the salt crystallizes in the gap G. The salt crystals may enter a gap between the face seal 43 and the case C, whereby the sealing performance of the face seal 43 may be decreased.

According to the present embodiment, as illustrated in FIG. 3 and FIG. 4, the extended-width groove 58 of the relief groove 57 is formed in the lower surface 51A of the tubular portion 51 of the outer housing 50. The extended-width groove 58 has a depth size which is substantially a half of the depth size of the seal groove 41, and the back surface 57A of the relief groove 57 is set at substantially the same height position as the upper surface of the seal body 44 of the face seal 43. Accordingly, the gap G between the tubular portion 51 and the case C is greater than the gap between the lower surface 40A of the flange 40 and the case C.

This makes it possible to prevent accumulation of salt water in the gap G between the back surface 57A of the relief groove 57 and the case C due to surface tension. Accordingly, the decrease in sealing performance of the face seal 43 due to penetration of the gap G by salt water can be prevented. In addition, the sealing performance of the face seal 43 can be ensured.

Further, according to the present embodiment, the extended-width groove 58, as illustrated in FIG. 2, includes the openings 59 at the positions where, at the side surfaces 51B of the tubular portion 51, the distance from the seal groove 41 to the side surfaces 51B of the tubular portion 51 is the shortest. Accordingly, the salt water that has penetrated the extended-width groove 58 can be easily discharged outside. Thus, the accumulation of the salt water in the gap G can be further prevented.

Second Embodiment

A second embodiment will be described with reference to FIG. 5 and FIG. 6.

The second embodiment illustrates an outer housing 150. The outer housing 150 includes a modification of the shape of the relief groove 57 of the outer housing 50 in the first embodiment. In the second embodiment, description of configurations, operations, and effects which are similar to those of the first embodiment is omitted to avoid a redundancy of the description. Configurations similar to those of the first embodiment are designated with similar reference signs.

Figure 6:
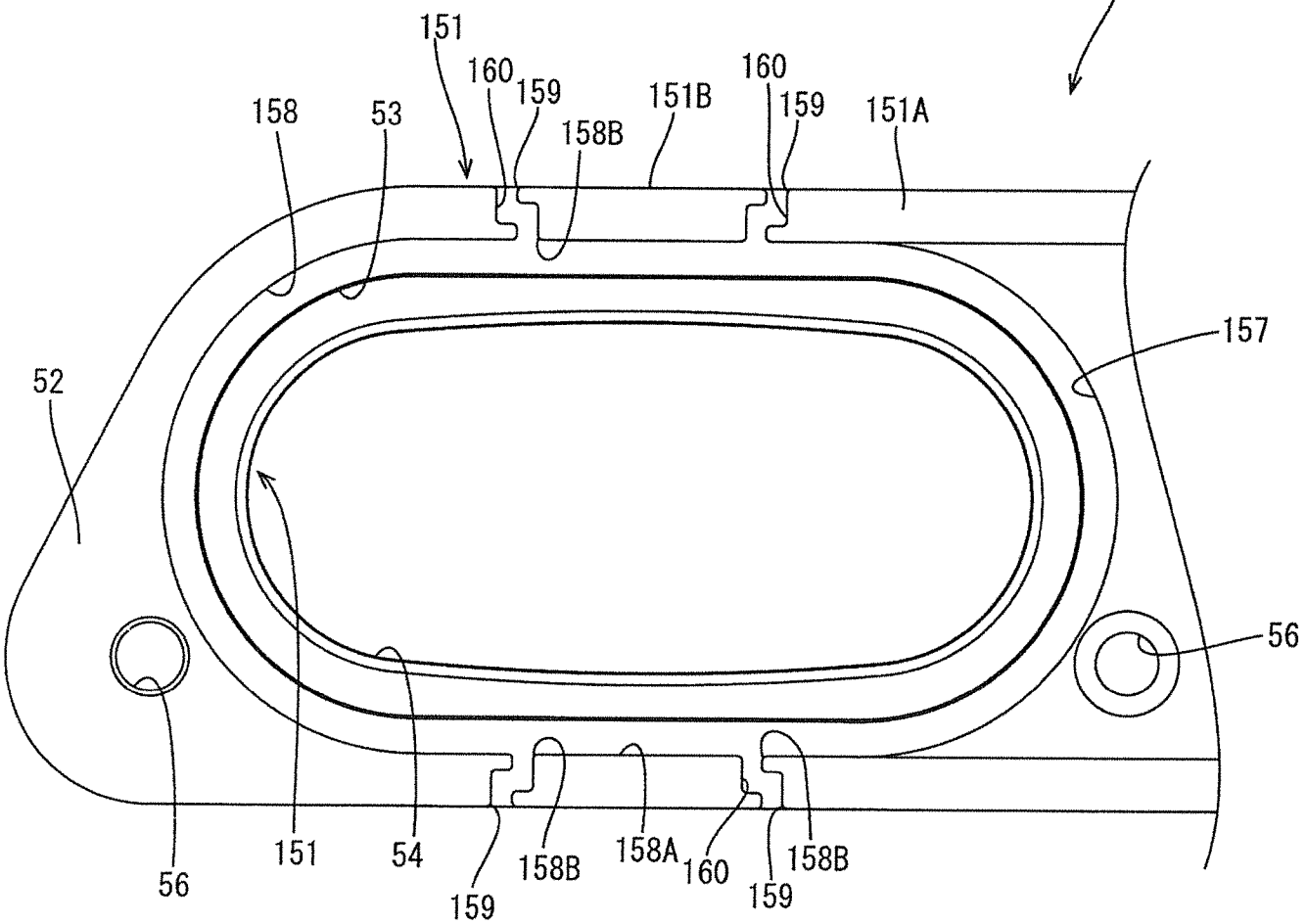
FIG. 6 is a bottom view of the same.

As illustrated in FIG. 6, a relief groove 157 according to the second embodiment has an extended-width groove 158 of which the groove width is narrower than that of the extended-width groove 58 of the first embodiment, and which is only formed at an inner peripheral edge portion of a lower surface 151A of a tubular portion 151. The relief groove 157 includes drainage channels (an example of "discharge channel") 160, radially outside the extended-width groove 158, for providing communication between the extended-width groove 158 and an external space S laterally of the tubular portion 151.

As illustrated in FIG. 6, the drainage channels 160 are formed between an inner peripheral surface 158A radially outside the extended-width groove 158 and side surfaces 151B of the tubular portion 151, and are bent outward in the width direction in a crank shape from the center in the width direction. The drainage channels 160 are opened on the inner peripheral surface 158A of the extended-width groove 158 and the side surfaces 151B of the tubular portion 151. Openings 158B of drainage channels 160 on the extended-width groove 158 side and openings 159 on the side surfaces 151B of the tubular portion 151 are disposed with an offset (displaced) from each other circumferentially so as not to radially overlap.

Figure 5:
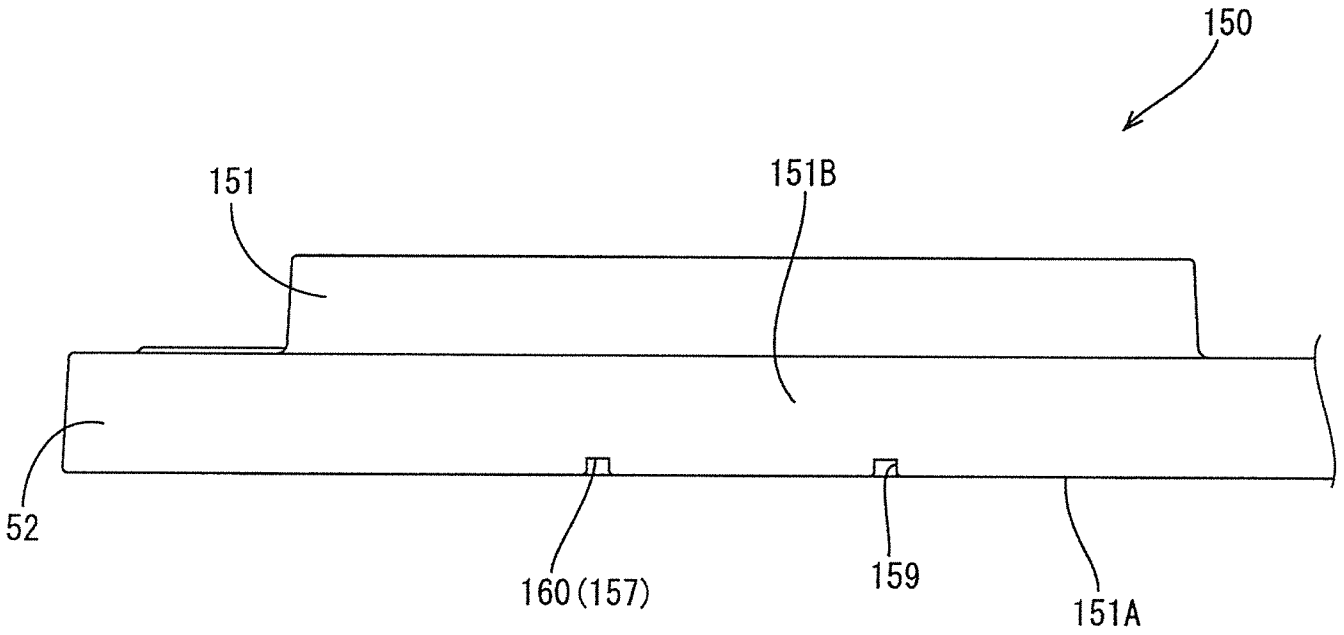
FIG. 5 is a front view of an outer housing of a device connector according to a second embodiment.

Thus, as illustrated in FIG. 5 and FIG. 6, when viewed laterally of the tubular portion 151, the drainage channels 160 are not radially linear. Accordingly, when, during cleaning, for example, high pressure water is sprayed into the openings 159 of the side surfaces 151B of the tubular portion 151, forceful penetration of the water into the extended-width groove 158 can be suppressed. In this way, direct spraying of high pressure water against the face seal 43 can be prevented, and the sealing performance of the face seal 43 can be ensured.

Other Embodiment

The technology disclosed in the present description is not limited to the embodiments described above with reference to the drawings, and may include various other modes, such as the following.

(1) In the embodiments, the extended-width grooves 58, 158 are configured with a substantially equal width along the entire circumference. However, this is not a limitation, and the extended-width groove may be partly configured to be wider or narrower.

(2) In the embodiments, the housing 30 is constructed of the inner housing 31 made of synthetic resin and the outer housing 50 made of die-cast aluminum, and the relief groove 57 is configured in the lower surface of the tubular portion 51 of the outer housing 50. However, this is not a limitation, and the housing may be constructed of a single type of member, and the relief groove may be configured in the lower surface of the housing.

(3) In the embodiment, the lips 45 are configured in two ridges on each of the upper and lower surfaces of the seal body 44. However, this is not a limitation, and three or more lips may be configured on each of the upper and lower surfaces of the seal body.

(4) In the first embodiment, the openings 59 are configured at two locations in the long side portions of the extended-width groove 58. However, this is not a limitation, and the opening of the extended-width groove may be configured in only one of the long side portions, or the opening may be configured in a short-side portion of the extended-width groove.

(5) In the second embodiment, the drainage channels 160 are configured so as to be bent in crank shape. However, this is not a limitation, and the drainage channels may be configured so as to be inclined more toward the circumferential direction as they become closer to the side surface of the tubular portion from the extended-width groove.

EXPLANATION OF SYMBOLS

10: Device connector
30: Housing
31: Inner housing (housing)
41: Seal groove
42: Back surface of seal groove
43: Face seal (seal member)
50: Outer housing (housing)
57, 157: Relief groove
58, 158: Extended-width groove
59, 159: Opening of relief groove
160: Drainage channel (discharge channel)
C: Case
C1: Attachment opening
S: External space

The invention claimed is:

1. A device connector to be attached to a case of a device, the device connector comprising:

a housing to be fitted in an attachment hole of the case, the housing including:

an inner housing including a seal groove extending along an outer peripheral surface of an entire perimeter of the inner housing and a back surface of the seal groove disposed opposite an outer peripheral edge portion of the attachment hole of the case; and an outer housing including a relief groove disposed circumferentially outward of and adjacent to the seal groove of the inner housing, the relief groove extending along the seal groove and being recessed relative to a surface of the outer housing opposite the outer peripheral edge portion of the attachment hole of the case; and a seal member fitted in the seal groove to waterproof a gap between the outer peripheral edge portion of the attachment hole and the back surface.

2. The device connector of claim 1, wherein the outer housing includes a void communicating with the relief groove.

3. The device connector of claim 2, wherein the outer housing includes a first section having a first thickness and a second section having a second thickness smaller than the first thickness; and the second section includes the void.

4. The device connector of claim 3, wherein the inner housing includes a flange protruding outward from the outer peripheral surface and extending for the entire perimeter of the inner housing;

the seal groove is defined by a surface of the flange opposite the outer peripheral edge portion of the attachment hole and a section of the outer peripheral surface of the inner housing closer to the outer peripheral edge portion of the attachment hole relative to the flange;

the outer housing includes a tubular portion including an inner surface opposite a distal end of the flange; and the tubular portion includes the relief groove, in a surface opposite the outer peripheral edge portion of the attachment hole.

5. The device connector of claim 4, wherein the void is formed in the tubular portion of the outer housing.

6. The device connector of claim 4, wherein the outer housing includes a planar fixing piece extending outward from the tubular portion in a direction parallel to the outer peripheral edge portion of the attachment hole; and the planar fixing piece includes a through hole into which a bolt is passed through in a thickness direction of the planar fixing piece.

7. The device connector of claim 4, wherein the void includes a first opening in an outer peripheral surface of the outer housing and a second opening in an inner peripheral surface of the outer housing; and The first opening and the second opening are away from each other in a direction in which the relief groove extends.

8. The device connector of claim 2, wherein the outer housing includes a planar fixing piece extending outward from the tubular portion in a direction parallel to the outer peripheral edge portion of the attachment hole; and the planar fixing piece includes a through hole into which a bolt is passed through in a thickness direction of the planar fixing piece.

9. The device connector of claim 2, wherein the void includes a first opening in an outer peripheral surface of the outer housing and a second opening in an inner peripheral surface of the outer housing; and The first opening and the second opening are away from each other in a direction in which the relief groove extends.

* * * * *